US005167577A

United States Patent [19]

Kristensson

[11] Patent Number: 5,167,577

[45] Date of Patent: Dec. 1, 1992

[54] INTAKE AIR UNIT

[76] Inventor: Jan A. A. Kristensson, Syrenvägen 1, S-262 62 Ängelholm, Sweden

[21] Appl. No.: 747,613

[22] Filed: Aug. 20, 1991

[30] Foreign Application Priority Data

Aug. 22, 1990 [SE] Sweden ..... 9002712

[51] Int. Cl.[5] ..... F24F 13/06

[52] U.S. Cl. ..... 454/298; 55/418; 454/66

[58] Field of Search ..... 55/418, 487; 454/66, 454/152, 158, 296, 297, 298

[56] References Cited

U.S. PATENT DOCUMENTS

| | | | |
|---|---|---|---|
| 3,084,609 | 4/1963 | Onstad | 454/296 |
| 3,180,363 | 4/1965 | Knarbakk | 55/418 X |
| 3,719,134 | 3/1973 | Korinth | 454/154 |
| 4,061,082 | 12/1977 | Shuler . | |
| 4,805,521 | 2/1989 | Eckebrink | 454/296 X |
| 4,890,544 | 1/1990 | Aalto et al. | 454/297 |

FOREIGN PATENT DOCUMENTS

| | | | |
|---|---|---|---|
| 0271652 | 9/1987 | European Pat. Off. . | |
| 53353 | 12/1977 | Finland . | |
| 2155170 | 9/1985 | United Kingdom | 454/297 |

*Primary Examiner*—Harold Joyce
*Attorney, Agent, or Firm*—Harpman & Harpman

[57] ABSTRACT

An intake air unit for supplying air to premises in order to create therein a zone with clean air, whereby the temperature of the air supplied is preferably the same as or lower than the temperature in the premises. Air resistance is provided inside the intake air unit so that air entering said unit is distributed to flow out into said premises through essentially all portions of an air discharge member. In order to permit efficient ventilation without draft the air discharge member comprises a porous material of air filter type, which material is adapted to sieve the discharged air for generating a continuous air flow outside the air discharge unit which is of a substantially same width as said air discharge unit.

5 Claims, 4 Drawing Sheets

INTAKE AIR UNIT

BACKGROUND OF THE INVENTION

The present invention relates to an intake air unit for supplying air to premises in order to create therein a zone with clean cool air whereby the temperature of the air supplied is preferably the same as or lower than the temperature in the premises and wherein an air resistance is provided inside the intake air unit so that air entering said unit is distributed to flow out into said premises through essentially all portions of an air discharge member.

There are many devices for supplying clean and/or cool air to the work place in order to create a clean and/or correctly tempered air zone. There exist, however, a number of contrasting relationships which are difficult to overcome. Such a contrasting relationship is that it requires an effective ventilation which must be free of draft and which may not allow surrounding impure and/or hot air to mix with the incoming air flow to a too great extent. See for example U.S. Pat. No. 4,061,082, Findland patent 53353 and European patent 271652.

In U.S. Pat. No. 4,061,082 an air filtering and distribution device can be seen having a walled enclosure with an inlet and a pair of spaced outlet filters A pair of vertically aligned and spaced diffuser plates are supported by a petition wall which defines the separate filtered outlets. The diffuser plates are perforated and can be adjusted in relation to the inlet for variations in air flow.

The Finland patent 53353 discloses an air dispersion device having a central inlet and an apertured spaced air guide and an apertured bottom outlet plate. Oppositely disposed side walls have openings within and a closure element is positioned over a portion of the outlet plate.

In European patent 271652 a displacement and flow device is shown having a housing with a plurality of jets in the bottom thereof spaced in relation to one another to disburse the air flow and diminish turbulence normally associated therewith.

SUMMARY OF THE INVENTION

An intake air unit which permits efficient ventilation of an enclosure without drafts and without mixing surrounding impure and hot air into the incoming air flow to a great extent. The air unit has a self-contained porous air filter adapted to sieve the discharged air providing a continuous air flow equal to the size of the discharge unit.

DESCRIPTION OF THE PREFERRED EMBODIMENT

Figure 1:
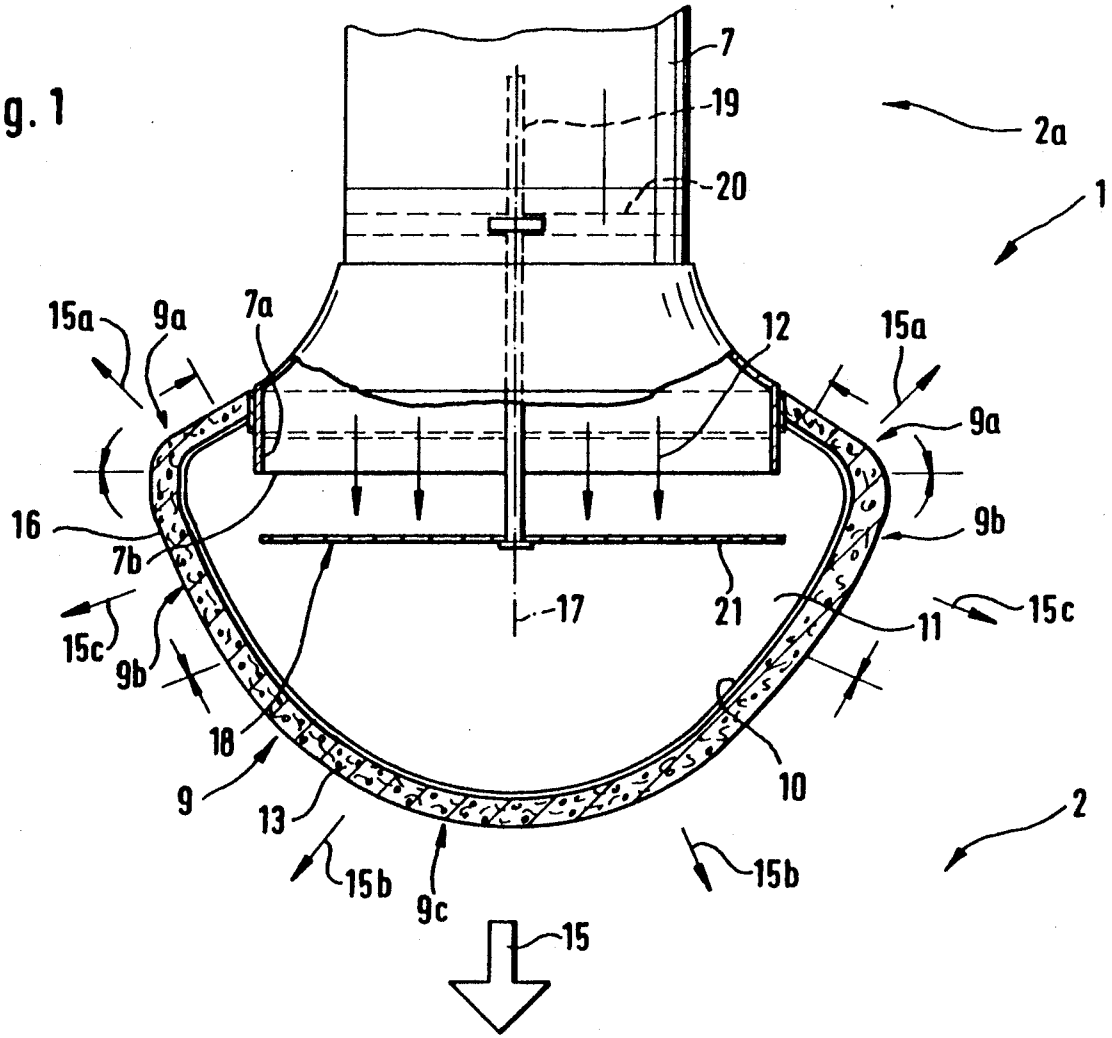
FIG. 1 is a vertical section through an intake air unit according to the invention.

The intake air unit 1 illustrated in the drawings is adapted to supply clean and/or cool air to premises 2, e.g. a workshop or an office, in order to create a zone 3,4 or 5 therein with clean and/or cool air.

Figure 7:
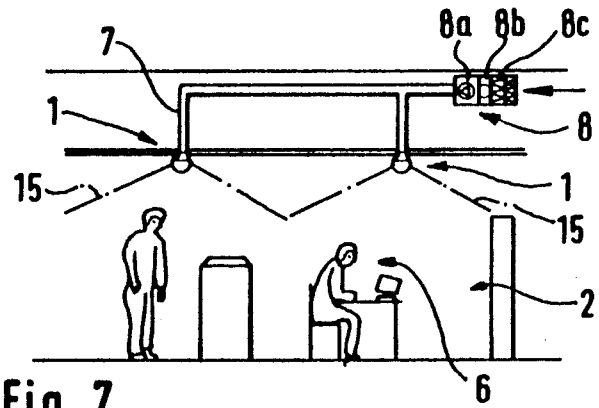
FIG. 7 schematically illustrates two intake air units according to the invention for providing several continuous fresh-air zones.

The intake air unit 1 is preferably adapted to supply air to the premises with a temperature that is the same as or lower than the temperature in said premises. The intake air unit 1 is located in the premises 2 preferably above the work place 6 which is to be supplied with clean and/or cool air. The clean and/or cool air is supplied to the intake air unit 1 through through a tube 7 or similar, which preferably hangs down and which preferably also defines a suspension device for the intake air unit 1. The air to the intake air unit 1 is supplied through an air inlet to a device 8 (see FIG. 7) including a fan aggregate 8*a* for feeding the air to a air discharge member 9 and out therethrough. The device 8 also includes a filter aggregate 8*b* for filtering the air and collecting impurities therefrom before the air reaches and passes a porous material 13 within the air discharge member 9. It is therefore ensured that the impurities do not plug up or clog the porous material 13. The filtering effect of the filter aggregate 8*b* is preferably adapted to the filtering effect of the porous material 13. The filtering effect of the filter aggregate 8*b* may e.g. be higher than that of the porous material 13. Furthermore, the device 8 may include a cooling aggregate 8*c* for cooling the air if necessary.

The intake air unit 1 includes a substantially downwardly directed air discharge member 9 and an air resistance generating through flow member 10 located within said air discharge member 9 defining an inner space 11 and providing such an air resistance that the air flow 12 entering the inner space 11 of the intake air unit 1 is distributed inside said space 11 such that the air is discharged, uniformly distributed, through the air discharge member 9.

The air discharge member 9 consists of or includes a porous material 13 of air filter type, said material being adapted to sieve the discharged air for defining on the outside of the air discharge member 9*a* a continuous air flow 15 of the same width as said air discharge member 9. It has been noticed that by means of a porous material 13 of air filter type, it is possible to generate a continuous, turbulent-free, slow air flow which free of draft can be supplied to the work place 6. While the through flow spaces in this porous material lie very close to each other and are numerous, the air is sieved outwards as a large number of small, close to each other discharged air flows, which immediately outside the air discharge member 9 are brought together to a continuous air flow 15 substantially without any clearly defined part air flows, but instead is discharged as a kind of substantially unbroken air curtain. While the air flow 15 is continuous, surrounding air is prevented from being ejected therewith or at least from being ejected therewith to a substantial degree. Instead, a limited zone with clean and/or cool air is obtained in the premises 2, while the surrounding air in the premises 2 at least at times may remain less clean and/or warmer.

The porous material 13 preferably comprises cellular bodies of plastic foam, e.g. of polyethylene covered with a thin layer of PVC, whereby the cellular bodies have a large number of pores through which the air is discharged. Such a porous material 13 has a low weight and has in certain cases been used as an air filter material.

Alternatively, other porous materials, e.g. a suitable fiber material may be used.

The air resistance generating through flow member 10 may preferably consist of a porous inner layer which e.g. covers the inner side of the porous material 13 and which preferably has a larger air resistance generating property than said porous material 13.

In order to impart self-supporting properties to the air discharge member 9, it is possible to use, instead of the PVC covered polyethylene foam 13, another porous material provided with an outer covering 16 which preferably is difficult to ignite and which consists of e.g. heat resisting plastic or wire netting.

The air discharge member 9 discharges a continuous air flow 15 at a suitable discharge speed of 0, 3–1 m/s and with a speed in the dwelling zone of 0,05–0,2 m/s, depending on the type of premises 2 and/or work place 6 and/or the desired size and/or shape of the zone 3,4 or 5.

The air discharge member 9 is preferably at upper portions 9*a* mounted on such lower end portions 7*a* of the tube 7 which expand in downward direction. Furthermore, a center line 17 of the air discharge member 9 is preferably an extension of the center line of the tube 7. The upper portions 9*a* extend in a downwardly/outwardly inclined direction, whereby they direct a portion 15*a* of the continuous air flow 15 in a direction substantially upwards/outwards for substantially preventing downwardly directed portions 15*b* of the continuous air flow 15 from ejecting air therewith from parts 2*a* of the premises located above the air discharge unit 1.

The upper portions 9*a* transform into middle or intermediate portions 9*b* which extend in a downward/inward direction relative to the center line 17 for directing portions 15*c* of the continuous air flow 15 outwardly/downwardly. The middle portions 9*b* transform down below into a semi-spherical lower portion 9*c* which is centered with the center line 17 and which is adapted to direct portions 15*b* of the air flow 15 substantially downwards.

Inside the air discharge member 9 of the intake air unit 1 there is provided an air guide unit 18 with a vertically directed rod 19 which is displaceably mounted in a bracket 20 in the tube 7. Preferably, the rod 19 projects downwards through the lower opening 7*b* of the tube 7 into the air discharge member 9 and it is preferably centered with the center line 17.

On the lower end of the rod 19 there is provided an air permeable guide plate 21 which is located under the opening 7*b* and transverse relative to the air flow 12 flowing through said opening 7*b*. The diameter of the guide plate 21 preferably substantially corresponds with the diameter or similar of the opening 7*b* and preferably also with the major part of the inner diameter or similar of the air discharge member 9 close to said opening 7*b*.

The air guide unit 18 is adapted to completely or partially prevent the air flow 12 entering through the opening 7*b* from flowing directly to the lower portions 9*c* of the air discharge member, but instead guide the air flow completely or partially to the sides towards the upper portions 9*a* and middle or intermediate portions 9*b* of said air discharge member 9. The air guide unit 18 can be set at various distances from the opening 7*b* for spreading the air flow 12 in various degrees downwards and to the sides in the inner space 11.

Figure 2:
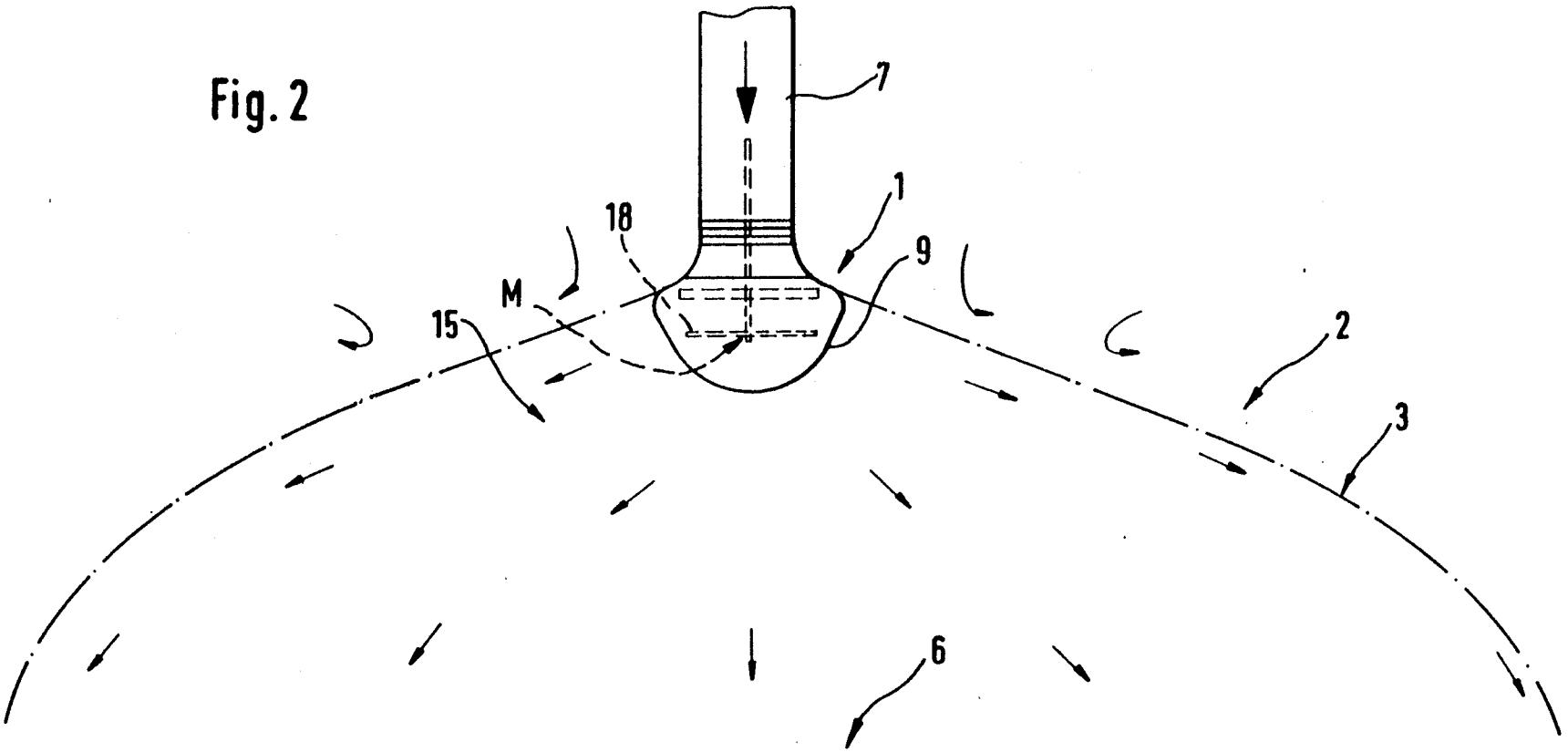
FIG. 2 is a side view of an intake air unit according to the invention during generation of a wide zone of fresh air directly beneath said unit.

Thus, the air guide unit 18 can be set in a middle or intermediate position M, see FIG. 2 of the drawings, about halfway between the opening 7*b* and the lower portions 9*c* of the air discharge member 9 for allowing propagation of the air flow 15 straight downwards as well as to the sides with substantial spreading, which means that a wide zone 3 with clean and/or cool air is obtained beneath the intake air unit 1.

Figure 3:
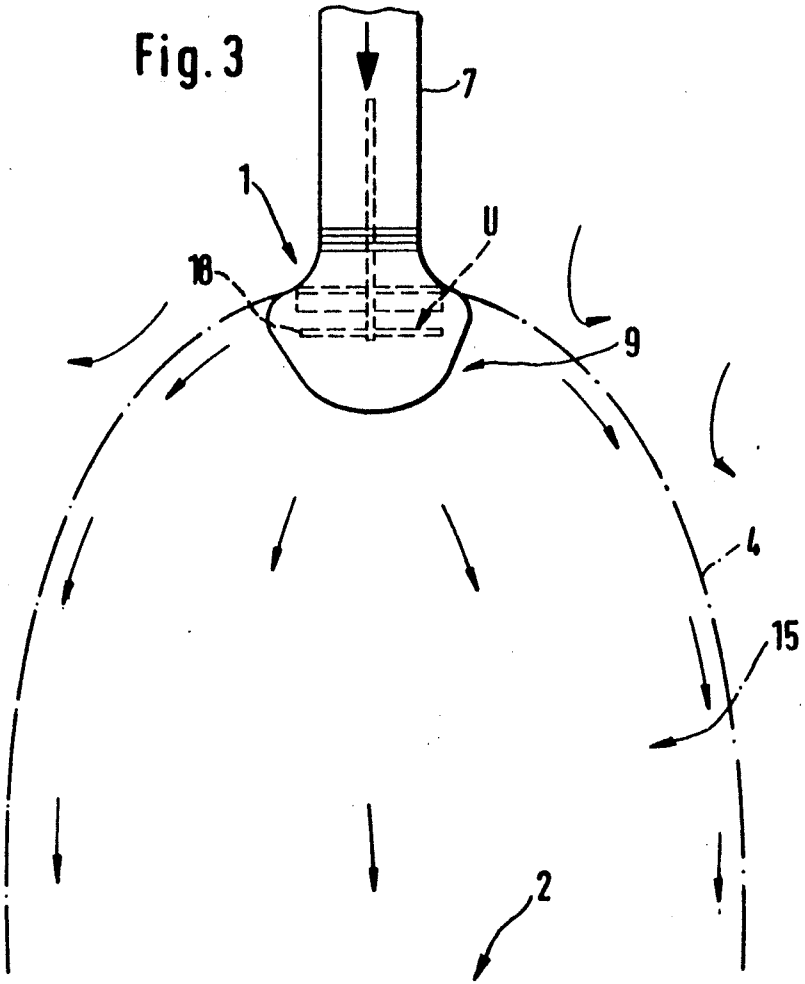
FIG. 3 is a side view of an intake air unit according to the invention during generation of a narrow fresh-air zone directly beneath said unit.

The air guide unit 18 is also settable in an upper position U, see FIG. 3 of the drawings, adjacent to the opening 7*b* for allowing propagation of the continuous air flow 15 straight downwards with less spreading to the sides, whereby a rather narrow zone 4 with clean and/or cool air is obtained beneath the intake air unit 1.

Figure 4:
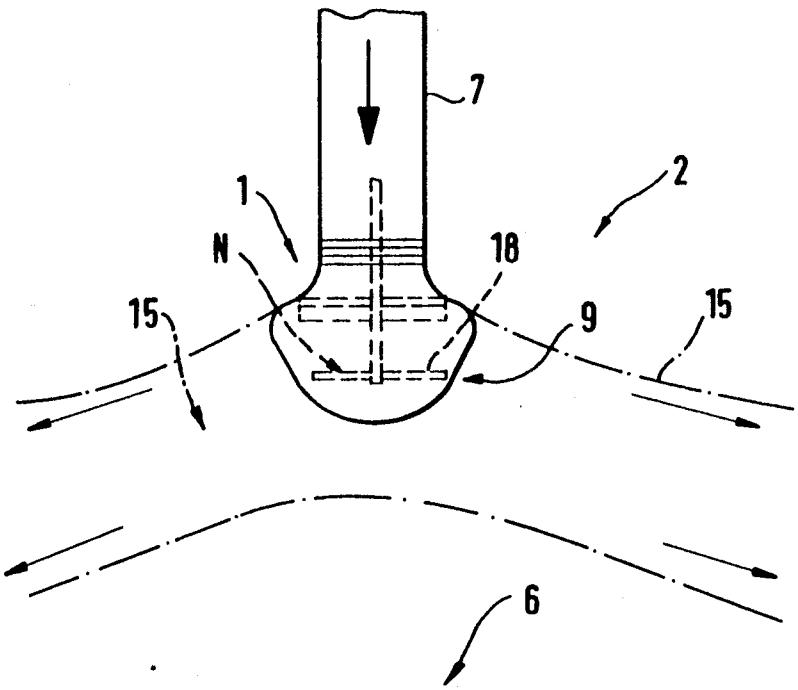
FIG. 4 is a side view of an intake air unit according to the invention during generation of an annular fresh-air zone surrounding an area directly beneath said unit.

Furthermore, the air guide unit 18 is settable in a lower position N, see FIG. 4 of the drawings, adjacent to the lower portions 9*c* for allowing propagation of the continuous air flow 15 in a downwardly/outwardly inclined direction but not straight downwards, whereby an annular zone of great extension is obtained.

The air guide unit 18 can if required be set in other positions than the above and it can be set manually or by remote control with a suitable device (not shown).

Figure 6:
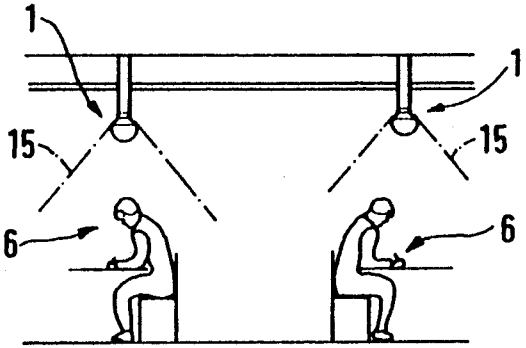
FIG. 6 schematically illustrates two intake air units according to the invention for spot-like supply of fresh air to two work places in an office.
Figure 8:
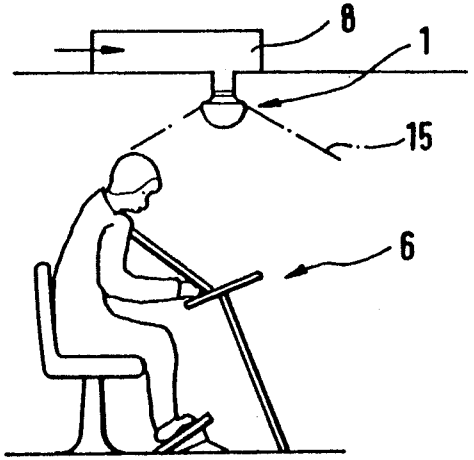
FIG. 8 schematically illustrates an intake air unit according to the invention provided for the supply of fresh air in small spaces.
Figure 5:
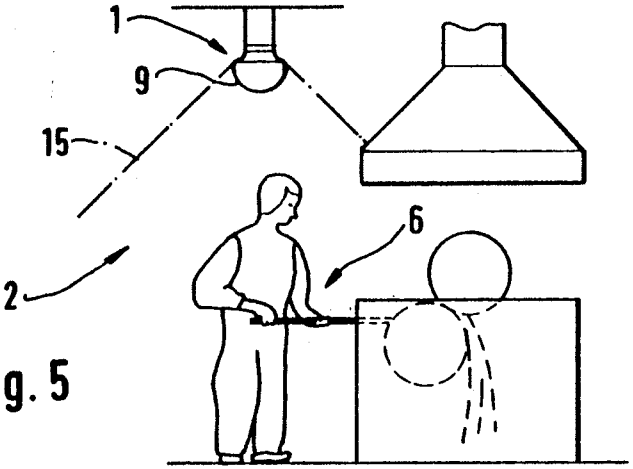
FIG. 5 schematically illustrates an intake air unit according to the invention for spot-like supply of fresh air to a work place in a workshop.

The intake air units 1 can be provided for spot supply of air and one intake air unit may be mounted at each wok place, see FIGS. 5 and 6 of the drawings. However, it is also possible to provide several intake air units 1 in premises 2 such that the air zones generated thereby meet each other, see FIG. 7 of the drawings, so that they together define one large air zone for many work places and/or other spaces. The intake air units 1 can also be mounted in small spaces, see FIG. 8 of the drawings, such as operators cabs or similar.

The invention is not limited to the embodiment described above and illustrated in the drawings, but may vary within the scope of the following claims. As an alternative, the intake air unit can eventually be located in another way than at the top in the premises and the shape of the air discharge member may be another than semi-spherical. The air guide unit may be of another type than shown and located in another way than shown.

I claim:

1. An intake air unit for supplying air to an enclosure in order to create and supply selective zones within said enclosure with clean cooled air, whereby the air supply is of a known temperature, an air guide unit in said intake air unit distributing said air flow through essentially all portions of an air discharge member, said air discharge member has an upper intermediary portion and is comprised of porous air filtering material adapted to sieve discharged air creating a continuous air flow from the intake air unit having the same width as said air discharge member, said air guide unit located beneath an opening through which air enters said air discharge member, whereby the air guide unit deflects the air flow entering through said opening towards the upper and intermediate portions of said air discharge member and means for setting the air guide unit at various distances from the opening for distribution of the air flow entering through said opening in various degrees downwardly and to the sides within said air discharge member.

2. The intake air unit of claim 1 wherein said porous material includes cellular bodies of plastic foam, e.g. polyethelene covered with PVC, said cellular bodies having a large number of pores through which the air is discharged.

3. The intake air unit of claim 1 wherein said air discharge member is directed downwards and has a semi-spherical shape for imparting the continuous air flow in a substantially downwardly expanding distribution, and has an outer covering adapted to give the air discharge member self-supporting properties and is of a heat resistant material and a porous inner layer with greater air resistance than said porous air filtering material distributing said air inside said air discharge member, and said air guide unit is settable in an intermediate position between the opening and said lower portions of the air discharge member for providing the air flow from the intake air unit straight downwardly as well as to the sides with substantial spreading, said air guide unit is settable in an upper position adjacent to said opening for allowing continuous air flow from the intake air unit downward and that said air guide unit is settable in a lower position adjacent said lower portion of the air discharge member for directing the continuous air flow from the intake air unit in a downwardly outwardly inclined direction.

4. The intake air unit according to claim 3 wherein said upper portions of the air discharge member are connected with a tube for supplying air to the interior of said discharge member, said tube preferably also defines a suspension device for said air discharge member, wherein said upper portions extend in an outwardly and downwardly inclined direction relative to a center line of the air discharge member, that said upper portion transforms into intermediate portions extending downwardly and inwardly relative to center line, and said intermediate portions down below transform into a semi-spherical lower portion which is centered with said center line.

5. The intake air unit according to claim 3 wherein said air guide unit comprises an air permeable guide plate which is positioned transversely relative to the air flow entering through the opening which has a diameter that is substantially the same as that of said opening, which has a diameter that corresponds with the major part of the interior diameter of said air discharge member so as to said opening and which is displaceably mounted in a tube for feeding air into the interior of aid air discharge member.

* * * * *